US009701109B2

(12) United States Patent
Watanabe

(10) Patent No.: US 9,701,109 B2
(45) Date of Patent: Jul. 11, 2017

(54) LIQUID DISCHARGING APPARATUS AND CONTROL METHOD OF LIQUID DISCHARGING APPARATUS

(71) Applicant: SEIKO EPSON CORPORATION, Tokyo (JP)

(72) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 14/795,287

(22) Filed: Jul. 9, 2015

(65) Prior Publication Data

US 2016/0009077 A1 Jan. 14, 2016

(30) Foreign Application Priority Data

Jul. 10, 2014 (JP) ..... 2014-142027

(51) Int. Cl.
*B41J 2/045* (2006.01)
*B41J 2/14* (2006.01)

(52) U.S. Cl.
CPC ..... *B41J 2/0451* (2013.01); *B41J 2/04551* (2013.01); *B41J 2/04581* (2013.01); *B41J 2/04593* (2013.01); *B41J 2/04596* (2013.01); *B41J 2/14274* (2013.01); *B41J 2002/14354* (2013.01)

(58) Field of Classification Search
CPC ..... B41J 2/2142; B41J 2/0451; B41J 29/393; B41J 2/16579; B41J 2/165; B41J 2/125; B41J 2/2139; B41J 2/04558; B41J 2/04561; B41J 2/0458; B41J 62/04593
See application file for complete search history.

(56) References Cited

U.S. PATENT DOCUMENTS 6,547,352 B1 * 4/2003 Ikeda ..... B41J 2/04551 347/11
2006/0268035 A1 * 11/2006 Lee ..... B41J 29/393 347/12
2007/0030307 A1 * 2/2007 Jeong ..... B41J 2/2139 347/47
2013/0141484 A1 * 6/2013 Kasai ..... B41J 2/125 347/14

FOREIGN PATENT DOCUMENTS

JP 2010-221525 A 7/2010

* cited by examiner

*Primary Examiner* — Thinh H Nguyen
(74) *Attorney, Agent, or Firm* — Workman Nydegger

(57) ABSTRACT

When the discharging abnormalities detection circuit detects a state in which the ink droplet is not discharged from the first nozzle which discharges a relatively large ink droplet, a second recording mode is set, and in a recording process, the ink droplet discharges from a second nozzle without discharging the ink droplet from a first nozzle.

10 Claims, 6 Drawing Sheets

LIQUID DISCHARGING APPARATUS AND CONTROL METHOD OF LIQUID DISCHARGING APPARATUS

CROSS-REFERENCE TO RELATED APPLICATIONS

The entire disclosure of Japanese Patent Application No: 2014-142027, filed Jul. 10, 2014 is expressly incorporated by reference herein in its entirety.

BACKGROUND

1. Technical Field

The present invention relates to a liquid discharging apparatus such as an ink jet type recording apparatus and a control method of the liquid discharging apparatus, and more particularly, to a liquid discharging apparatus which introduces liquid stored in a liquid storage member to a liquid discharging head and discharges the introduced liquid as liquid droplets, and a control method of the liquid discharging apparatus.

2. Related Art

A liquid discharging apparatus is an apparatus which includes a liquid discharging head and discharges (that is, ejects) various types of ink from the liquid discharging head. As such a liquid discharging apparatus, for example, an image recording apparatus such as an ink jet type printer or an ink jet type plotter has been used; however, recently, the liquid discharging apparatus has been applied to various manufacturing apparatuses by utilizing a characteristic thereof in which a minimum amount of liquid accurately lands on a predetermined position. For example, the liquid discharging apparatus has been applied to a display manufacturing apparatus which manufactures a color filter such as a liquid crystal display, an electrode forming apparatus which forms an electrode such as an organic electro luminescence (EL) display or a surface light emission display (FED), and a chip manufacturing apparatus which manufactures a bio chip (biochemical element). A recording head of the image recording apparatus discharges ink of a liquid type, and a color material discharging head for the display manufacturing apparatus discharges a solution of each color material of R (Red), G (Green), and B (Blue). In addition, an electrode material discharging head for the electrode forming apparatus discharges an electrode material of a liquid type, and a biochemical organic substance discharging head for the chip manufacturing apparatus discharges a bio organic substance solution.

The liquid discharging apparatus introduces the liquid from a storage member which stores the liquid such as the ink or the electrode material to the liquid discharging head, and discharges the liquid from nozzles as liquid droplets. A load in the storage member increases according to that the apparatus consumes the liquid in the storage member by discharging the liquid. For this reason, there is a concern that when the liquid in the storage member is reduced, a lack of the liquid to be supplied to the liquid discharging head is generated, and the liquid droplets are difficult to normally discharge from the nozzles. In order to prevent such an uncomfortable situation, in the liquid discharging apparatus in this type, in a case of detecting a state in which the liquid in the storage member barely remains, a promotion to a user for exchange of the storage member has been performed by, for example, displaying the state on a display device, or the like which is installed in the liquid discharging apparatus. In general, in order to prevent a generation of discharge abnormalities as described above in advance, there is a margin at a predetermined degree of a remaining amount of the liquid at the time of detecting an empty state. For this reason, regardless of the remaining of liquid which is capable of still being used for discharging, the remaining amount of liquid becomes useless in a case in which the user exchanges the storage member according to information relating to the promotion for exchange. With respect to such a problem, a technology has been proposed in which a state of the small ink remaining amount is detected by examining whether or not the ink is normally discharged from the nozzles of the liquid discharging head (for example, refer to JP-A-2010-221525).

In a case of examining the discharge abnormalities, when the discharge abnormalities are generated in only one of a plurality of the nozzles installed in the liquid discharging head, for example, a problem of a dot missing state is generated at the time of recording an image, or the like, therefore, in general, the discharge abnormalities examination is performed on all of nozzles. However, when the discharge abnormalities examination is performed on all of the nozzles, there is a problem in that only this examination takes time as much.

SUMMARY

An advantage of some aspects of the invention is to provide a liquid discharging apparatus which is capable of suppressing a waste of liquid in a liquid storage member while reducing time which is needed to perform a discharge abnormalities examination with respect to nozzles, and a control method of the liquid discharging apparatus.

According to an aspect of the invention, there is provided a liquid discharging apparatus including: a liquid discharging head that includes a first nozzle which discharges a first size liquid droplet and a second nozzle which discharges a second size liquid droplet smaller than the first size liquid droplet; a discharging abnormalities detection circuit that detects a state in which the liquid droplet is discharged from the nozzle of the liquid discharging head; and a control circuit that controls discharging of the liquid droplet from the liquid discharging head, in which when the discharging abnormalities detection circuit detects a state in which the liquid droplet is not normally discharged from the first nozzle, the control circuit discharges the liquid droplet from the second nozzle without discharging the liquid droplet from the first nozzle.

In this case, when it is detected that the first nozzle does not normally discharge a relatively large amount of first liquid droplet, and the second nozzle discharges a relatively small amount of second liquid droplet without discharging the liquid droplet from the first nozzle, even in a state in which the liquid in the liquid storage member barely remains, the liquid droplet can be continuously discharged until a state in which the second liquid droplet is not normally discharged. In addition, it is sufficient that the discharge abnormalities examination is performed on a specific first nozzle which discharges the first liquid droplet, such that all of the nozzles do not need to be examined. Accordingly, time needed to examine the discharge abnormalities can be reduced and waste of the liquid in the liquid storage member can be suppressed.

In the liquid discharging apparatus, an opening area of the first nozzle may be larger than that of the second nozzle.

In this case, when it is determined that the discharge abnormalities are generated by performing the nozzle examination process on the specific first nozzle having a relatively large opening area, after that, the discharging operation is performed using only the second nozzle having a relatively small opening area. Accordingly, the driving pulse which drives the actuator for discharging the liquid droplet from the first nozzle at the time of the examination can be made common to the driving pulse which drives the actuator for discharging the liquid droplet from the second nozzle. In addition, since the examination object is specified as the first nozzle, a process does not need to be performed in which a nozzle of the examination object is set.

The liquid discharging apparatus may further includes: an actuator that discharges the liquid droplet from the nozzle; and a driving pulse generating circuit that generates a driving pulse which drives the actuator, in which the driving pulse generating circuit is capable of generating a first driving pulse for discharging the first size liquid droplet and a second driving pulse for discharging the second size liquid droplet, and the control circuit applies the first driving pulse to the actuator corresponding to the first nozzle and applies the second driving pulse to the actuator corresponding to the second nozzle.

According to another aspect of the invention, there is provided a control method of a liquid discharging apparatus including a liquid discharging head that includes a first nozzle which discharges a first size liquid droplet and a second nozzle which discharges a second size liquid droplet smaller than the first size ink droplet, a discharging abnormalities detection circuit that detects a state in which the liquid droplet is discharged from the nozzle of the liquid discharging head, and a control circuit that controls discharging of the liquid droplet in the liquid discharging head. The control method includes discharging a liquid droplet from a second nozzle without discharging the liquid droplet from a first nozzle when detecting a state in which the ink droplet is not normally discharged from the first nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment for implementing the present invention will be described with reference to attached drawings. Moreover, in the embodiments as follows, each of the embodiments is limited as appropriate specific examples of the invention; however, a range of the invention is not limited to a description as long as the description which is limited to the invention is not disclosed in the description hereinafter. In addition, hereinafter, as the liquid discharging apparatus of the invention, the ink jet type recording apparatus (hereinafter, referred to as a printer) will be described as an example.

Figure 1:
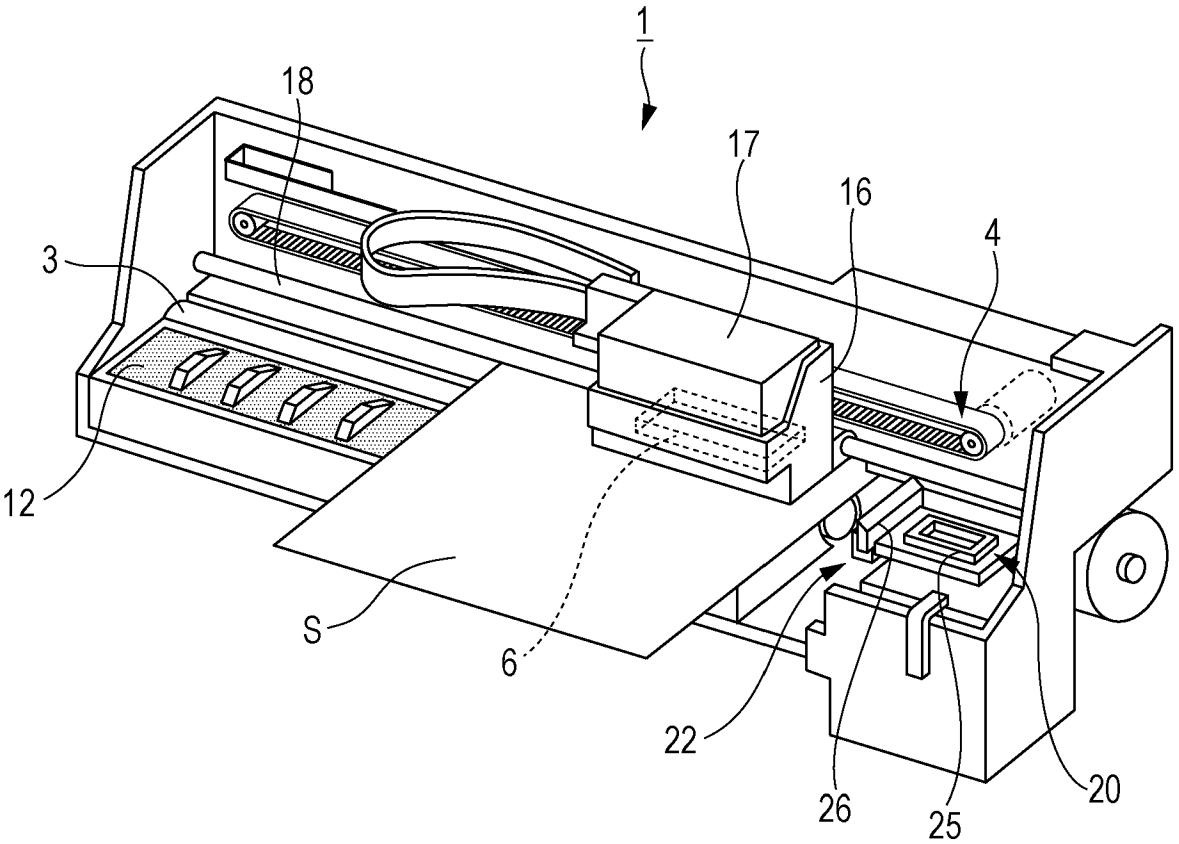
FIG. 1 is a perspective view illustrating an internal configuration of a printer.
Figure 2:
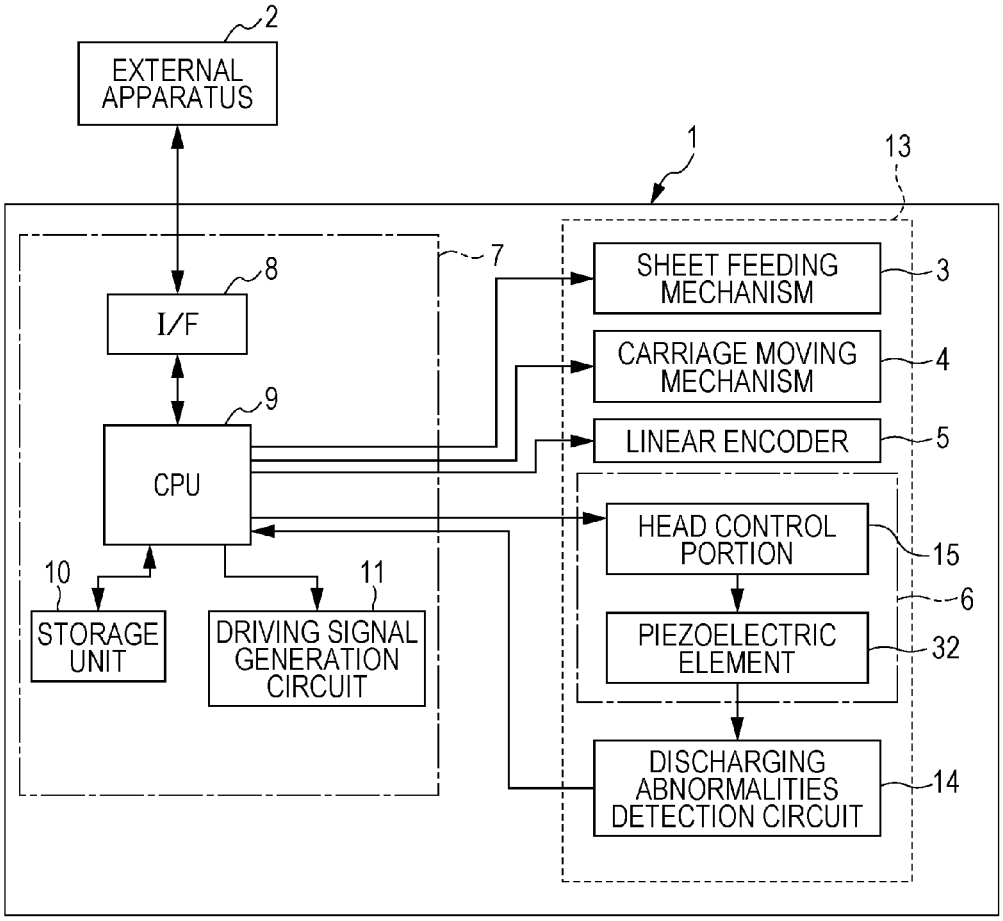
FIG. 2 is a block diagram illustrating an electrical configuration of the printer.

FIG. 1 is a perspective view illustrating an internal configuration of a printer 1, and FIG. 2 is a block diagram illustrating an electrical configuration of the printer 1. The printer 1 in the embodiment is electrically connected to, for example, an external apparatus 2 of an electronic apparatus such as a computer in a wired or wireless state and receives printing data according to an image, or the like, for printing the image or a text to a recording medium S (landing object of liquid) such as recording sheet from the external apparatus 2. The printer 1 includes a printer controller 7 and a printer engine 13. A recording head 6 as a type of the liquid ejecting head is installed on a bottom surface side of a carriage 16 in which an ink cartridge 17 (a type of liquid storage member) is mounted. The carriage 16 is configured to be capable of being reciprocated along a guide rod 18 by a carriage moving mechanism 4. That is, the printer 1 sequentially transports the recording medium S onto a platen 12 by a sheet feeding mechanism 3 and relatively moves the recording head 6 in a width direction (main scanning direction) of the recording medium S so that the image or the like is recorded by discharging the ink of a type of liquid in the invention from a nozzle 44 of the recording head 6 (refer to FIG. 3 and FIG. 4) and making the ink land onto the recording medium. Moreover, a configuration is adopted in which the ink cartridge 17 is disposed on a main body side of the printer, and the ink in the ink cartridge 17 is transferred to the recording head 6 side through a supply tube.

A home position as a standby position of the recording head 6 is set at a position deviated from one end side of the main scanning direction with respect to a platen 12 (front right side in FIG. 1). In the home position, a capping mechanism 20 and a wiping mechanism 22 are installed sequentially from one end side. The capping mechanism 20 includes, for example, the cap 25 made of an elastic member such as an elastomer, and is configured to be capable of being changed into a state (capping state) in which the cap 25 is brought into contact with a nozzle surface (nozzle plate 37) of the recording head 6 and sealed, or into an escape state in which the cap 25 is separated from the nozzle surface. By negatively pressurizing the inside of the cap with respect to the nozzle surface in the capping state, a cleaning process in which the ink is sucked from the nozzle 44 and is discharged into the cap can be performed. The wiping mechanism 22 includes a wiper 26 so as to be capable of being moved in a direction perpendicular to a main scan direction (nozzle row direction or sub scan direction), or the wiper 26 so as to be capable of being changed in a state of being brought into contact with the nozzle surface of the recording head 6 or an escape state in which the cap 25 is separated from the nozzle surface. The wiping mechanism 22 wipes the nozzle surface by being slid in a direction from one side to the other of the nozzle row 45 in a state in which the wiper 26 is brought into contact with the nozzle surface.

The printer controller 7 is a control unit that controls each of the units of the printer. The printer controller 7 in the embodiment includes an interface (I/F) unit 8, a CPU 9, a storage unit 10, and a driving signal generation circuit 11. The interface unit 8 transmits printing data or printing instructions from an external apparatus 2 to the printer 1 or performs receiving and transmitting of state data of the printer at the time of outputting information on a state of the printer 1 to the external apparatus 2. The CPU 9 controls the entirety of the printer. The storage unit 10 is an element storing data used in a program or various controls of the CPU 9 and includes a ROM, a RAM, and a NVRAM (non-volatile storage element). The CPU 9 controls each of the units according to a program stored in the storage unit 10. In addition, CPU 9 in the embodiment generates discharge data based on printing data from the external apparatus 2 by going through a color conversion process from a RGB color system to a CMY color system, a halftoning process that decreases multilevel data to a predetermined gradation, a dot pattern development process that develops data which is subjected to the halftoning process to a dot pattern which is arranged in a predetermined arrangement, and the like, and transmits the discharge data to a head control portion 15 of the recording head 6. Further, the CPU 9 in the embodiment functions as a control circuit that controls discharging of the ink droplets by the recording head 6. The driving signal generation circuit 11 generates a driving signal which includes a driving pulse (to be described later) for discharging the ink so as to record an image with respect to the recording medium such as recording sheet.

Next, the printer engine 13 will be described. The printer engine 13 includes, as illustrated in FIG. 2, a sheet feeding mechanism 3, a carriage moving mechanism 4, a linear encoder 5, a discharging abnormalities detection circuit 14, the recording head 6, and the like. The carriage moving mechanism 4 is configured to have a carriage 16 in which the recording head 6 is installed, a driving motor (for example, DC motor) making the carriage 16 moved through a timing belt, or the like (not illustrated), and moves the recording head 6 installed in the carriage 16 in the main scanning direction. The sheet feeding mechanism 3 is configured to have a sheet feeding motor, a sheet feeding roller, and the like (neither of them are illustrated), and performs sub-scanning by sequentially feeding the recording medium S onto the platen 12. In addition, the linear encoder 5 outputs an encoder pulse according to a scanning position of the recording head 6 installed in the carriage 16 as position information in the main scan direction to the printer controller 7. The printer controller 7 can recognize the scan position (current position) of the recording head 6 based on the encoder pulse received from the linear encoder 5. The discharging abnormalities detection circuit 14 is a mechanism that examines whether or not the ink is normally discharged from the nozzle 44 of the recording head 6. A nozzle examination process by the discharging abnormalities detection circuit 14 will be described later.

Figure 3:
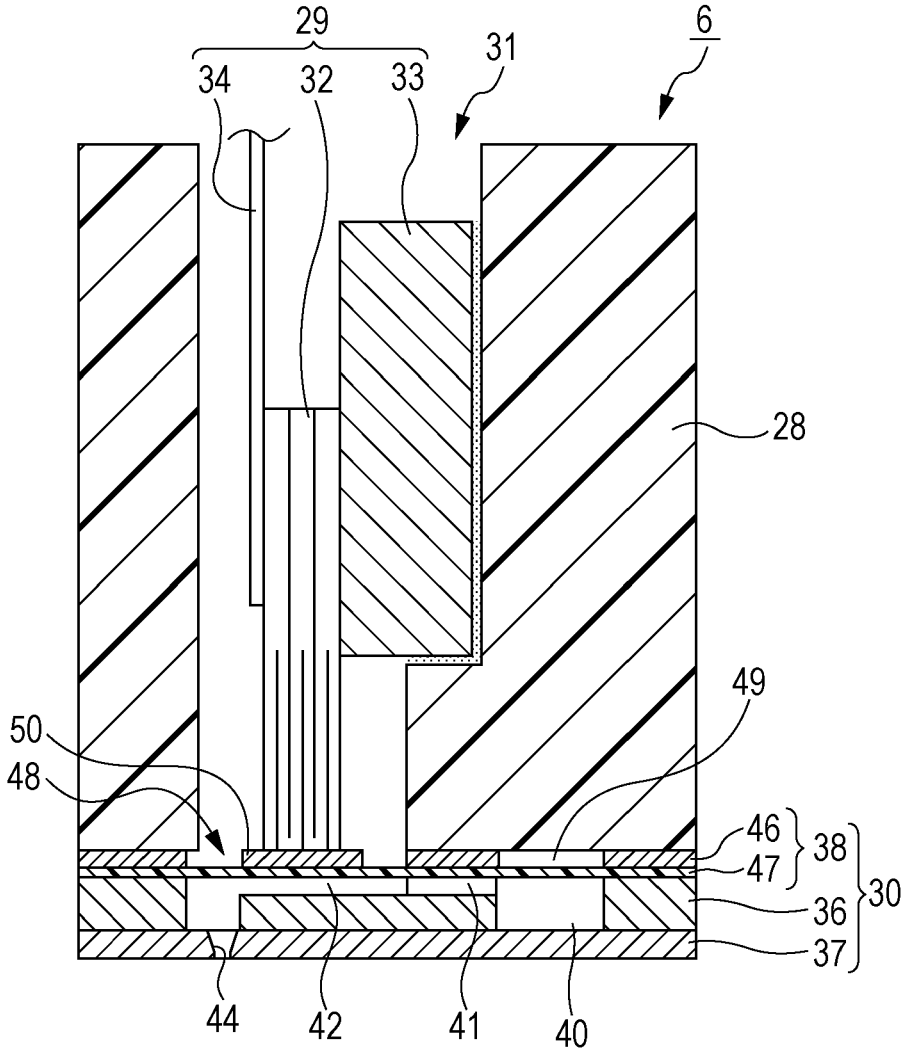
FIG. 3 is a cross-sectional view illustrating a main part of an internal configuration of a recording head.

FIG. 3 is a main part cross-sectional view illustrating an internal configuration of the recording head 6. The recording head 6 in the embodiment is configured to have a case 28, a vibrator unit 29 accommodated in the case 28, a flow passage unit 30 bonded to a bottom surface (edge surface) of the case 28, and the like. The above described case 28 is made of, for example, epoxy resin, and is provided with an accommodation space 31 that accommodates the vibrator unit 29 therein. The vibrator unit 29 includes a piezoelectric element 32 which functions as an actuator in the invention, a fixing plate 33 in which the piezoelectric element 32 is bonded, and a flexible cable 34 that supplies a driving signal, or the like to the piezoelectric element 32. The piezoelectric element 32 has a stacked shape manufactured by dividing a piezoelectric plate in which a piezoelectric layer and an electric layer are alternatively stacked in a comb-tooth shape, and is a so called piezoelectric oscillator of a vertical vibration mode extensible in a direction perpendicular to a stacked direction.

The flow passage unit 30 is configured to have a nozzle plate 37 which is bonded to one surface of a flow passage forming substrate 36 and a vibration plate 38 which is bonded to another surface of the flow passage forming substrate 36. In the flow passage unit 30, a reservoir 40 (common liquid chamber), an ink supply port 41, a pressure chamber 42, and a nozzle 44 are installed. A series of ink flow passages extending from the ink supply port 41 to the nozzle 44 through the pressure chamber 42 and a nozzle communication port 33 is respectively formed to correspond to each nozzle 44. The nozzle plate 37 is a plate material made of a metal such as a stainless, a silicon single crystal, or the like in which a plurality of nozzles 44 are perforated in a row shape at a pitch corresponding to a dot forming density.

Figure 4:
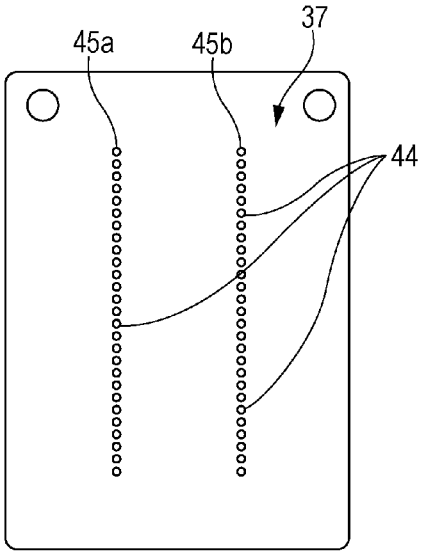
FIG. 4 is a plan view illustrating a configuration of a nozzle plate.

FIG. 4 is a view describing a configuration of the nozzle plate 37. The nozzle plate 37 in the embodiment has a configuration in which the nozzle row 45 (a type of nozzle groups) is configured to have 180 nozzles 44 discharging the ink which are formed in a row along a transportation direction of the recording medium S. The nozzle row 45 in the embodiment is formed of two nozzle rows 45*a* and 45*b* which are configured to have the nozzles 44 installed, for example, at a forming pitch of 180 dpi, and the nozzle rows are formed in parallel with each other on the nozzle plate 37 in a direction corresponding to a main scan direction of the recording head 6. Moreover, the number of the nozzles 44 constituting one nozzle row 45 or the number of the nozzle row 45 in the nozzle plates 37 is not limited to the examples.

The vibration plate 38 has a double-structure in which an elastic film 47 is stacked on a surface of a supporting plate 46. In the embodiment, the vibration plate 38 is made of a complex member in which the supporting plate 46 is used as a stainless plate which is a type of metal plate and a resin film as the elastic film 47 is laminated on the surface of the supporting plate 46. In the vibration plate 38, a diaphragm portion 48 which changes a volume of the pressure chamber 42 is installed. In addition, in the vibration plate 38, a compliance portion 49 which seals a part of the reservoir 40 is installed. In the diaphragm portion 48, an insular portion 50 is formed by partially removing the supporting plate 46 in an etching process, or the like. A compliance portion 49 is manufactured by removing the supporting plate 46 in a region facing an opening surface of the reservoir 40 by the same etching process as that of the diaphragm portion 48, and functions as a damper which absorbs a pressure change of the liquid stored in the reservoir 40.

Since a tip end of the piezoelectric element 32 is bonded to the insular portion 50, volume of the pressure chamber 42 can be changed by expanding and contracting the piezoelectric element 32. The pressure change is generated in the ink in the pressure chamber 42 according to the volume change. The recording head 6 discharges the ink droplets from the nozzle 44 using the pressure change.

Figure 5:
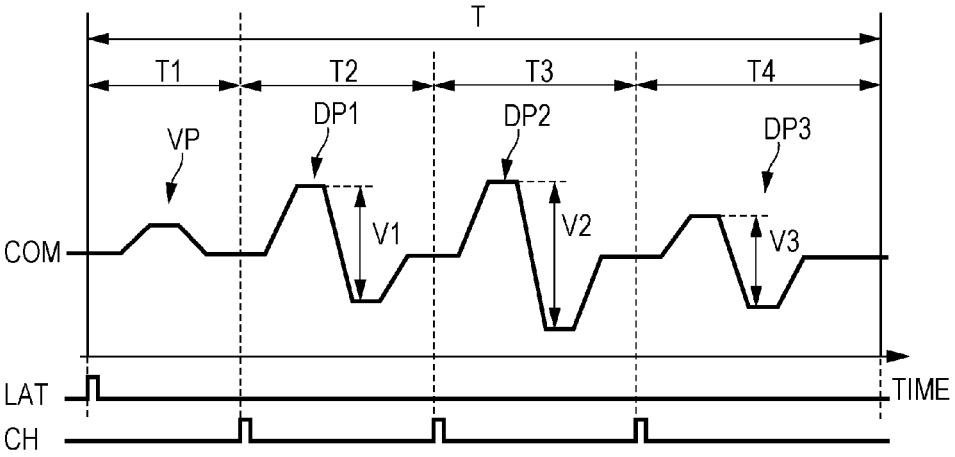
FIG. 5 is a waveform diagram illustrating a configuration of a driving signal.

FIG. 5 is a waveform diagram illustrating an example of a configuration of a driving signal COM which is generated by the driving signal generation circuit 11 (corresponding to the driving pulse generating circuit of the invention). The driving signal COM is repeatedly generated from the driving signal generation circuit 11 in every unit period T which is regulated by a latch signal LAT generated on the basis of the above described encoder pulse. The unit period T corresponds to, for example, a time when the nozzle 44 is moved at only a distance corresponding to one pixel which is a configuration unit of an image, or the like printed on the recording medium S. In the embodiment, the unit period T is divided into total four periods of a first period T1, a second period T2, a third period T3, and a fourth period T4 by a change signal CH generated on the basis of the latch signal LAT. A vibration driving pulse VP is generated in the first period T1, a first discharge driving pulse DP1 is generated in the second period T2, a second discharge driving pulse DP2 is generated in the third period T3, and a third discharge driving pulse DP3 is generated in the fourth period T4. When the recording head 6 is moved to a section corresponding to a recording region on the recording medium S during the printing process, at least one of the driving pulses of the driving signals COM is selectively applied to the piezoelectric element 32 provided in each pressure chamber 42. Specifically, when the recording head 6 is moved to the section corresponding to the recording region, any one of the discharge driving pulses DP1 to DP3 is selected and applied to the piezoelectric element 32 corresponding to the nozzle 44 which discharges the ink in a predetermined period. Meanwhile, in the piezoelectric element 32 corresponding to the nozzle 44 (that is, non-discharging nozzle) which does not discharge the ink in a predetermined period in the section corresponding to the recording region, the vibration driving pulse VP is applied, and the ink in the pressure chamber 42 and the nozzle 44 is vibrated (minute vibration) at a degree in which the ink is not discharged from the nozzle 44. Moreover, shapes of the vibration driving pulse VP and the discharge driving pulses DP1 to DP3 are not limited to the examples, and various waveforms are adopted in response to an ink amount discharged from the nozzle 44, or the like.

All of the discharge driving pulses DP1 to DP3 is a driving pulse (corresponding to the driving pulse in the invention) for discharging the ink from the nozzle 44. In the embodiment, these discharge driving pulses DP1 to DP3 are set to have different voltages (potential difference from lowest potential to highest potential) from each other. Specifically, compared to voltage V1 of the first discharge driving pulse DP1, voltage V2 of the second discharge driving pulse DP2 is set to be large. In addition, compared to the voltage V1 of the first discharge driving pulse DP1, voltage V3 of the third discharge driving pulse DP3 is set to be large. That is, the voltages of the discharge driving pulses DP1 to DP3 become a relationship of $V3<V1<V2$. Flying speed Vm or weight Iw of the ink discharged from the nozzle 44 increase as the voltage of the discharge driving pulse becomes higher, and the flying speed Vm or the weight Iw of the ink discharged from the nozzle 44 decrease as the voltage of the discharge driving pulse becomes lower. The second discharge driving pulse DP2 in the embodiment is a driving pulse which is set to discharge the ink droplet (corresponding to a first size liquid droplet in the invention) corresponding to a dot having a maximum weight and volume, and is a first driving pulse in the invention. In addition, the third discharge driving pulse DP3 is a driving pulse which is set to discharge the ink droplet corresponding to a dot having a minimum weight and volume. The first discharge driving pulse DP1 is a driving pulse which is set to discharge the ink droplet corresponding to a medium-sized dot having a weight and a volume smaller than the large-sized ink droplet and larger than the small-sized ink droplet. In the embodiment, the ink droplet corresponding to the medium-sized dot and the small-sized dot having a weight and a volume smaller than the ink droplet corresponding to the first large-sized dot corresponds to the second size liquid droplet in the invention. Accordingly, the first discharge driving pulse DP1 and the third discharge driving pulse DP3 correspond to the second driving pulse in the invention. In addition, the nozzle 44 which discharges the ink droplet corresponding to the large-sized dot corresponds to the first nozzle in the invention, and the nozzle 44 which discharges the ink droplet corresponding to the medium-sized dot or the small-sized dot corresponds to the second nozzle in the invention. Therefore, in the embodiment, even though the nozzles 44 are the same as each other, the ink droplet corresponding to the large-sized dot is discharged from the first nozzle, or the ink droplet corresponding to the medium-sized dot or the small-sized dot is discharged from the second nozzle in response to a gradation to be recorded in every unit period.

In the printer 1 according to the invention, there is a characteristic in that, for example, an examination (nozzle examination process) is regularly performed whether or not the ink is normally discharged from the nozzles 44 when the recording head 6 performs the recording process on the recording medium S, and a select control of the discharge driving pulse with respect to the piezoelectric element 32 in the recording process according to a examination result is changed. Hereinafter, the characteristic will be described.

Figure 6:
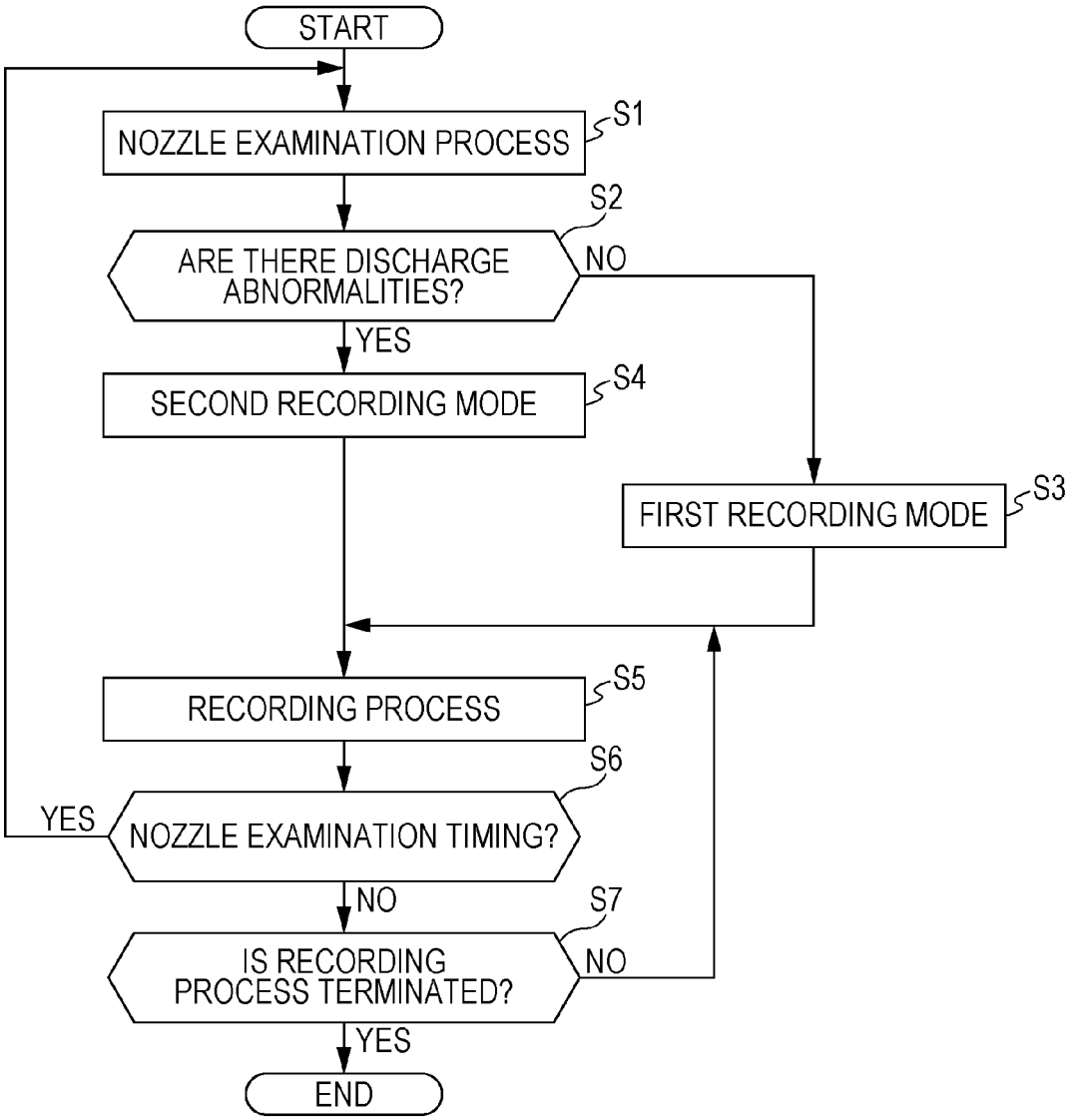
FIG. 6 is a flow chart illustrating a flow of a control of the printer.

FIG. 6 is a flow chart illustrating a flow of a control of the printer 1. First, the nozzle examination process is performed before the recording process starts (Step S1). In the nozzle examination process, the carriage 16 is moved to an upper portion of a capping mechanism 20 by the carriage moving mechanism 4, and the nozzle surface of the recording head 6 faces the cap 25. In this state, by performing an operation in which the nozzle 44 of a first examination object among all nozzles 44 is set, the ink droplet corresponding to the large-sized dot is discharged from the nozzle 44, it is determined whether or not the ink is normally discharged.

As a method for determining whether or not the ink is normally discharged from the nozzle 44, various known methods can be used; however, in the embodiment, the discharging abnormalities detection circuit 14 determines whether or not the ink is normally discharged from the nozzle 44 according to counter electromotive force of the piezoelectric element 32 based on the vibration generated at the time of driving the piezoelectric element 32. After the piezoelectric element 32 is driven, the vibration plate 38 which is an operation portion of the pressure chamber 42 is vibrated in response to the pressure vibration generated in the ink in the pressure chamber 42. According to this, the piezoelectric element 32 is also vibrated, and the counter electromotive force is generated on the basis of the vibration. The discharging abnormalities detection circuit 14 outputs a counter electromotive force signal of the piezoelectric element 32 to the CPU 9. For example, at the time of an abnormality in a case of a so called dot-missing in which the ink is not discharged from the nozzle 44, in a case in which the amount or flying speed of the discharged ink is significantly reduced with respect to the target value even though the ink is discharged from the nozzle 44, or the like, a period component, an amplitude component, and a phase component of the counter electromotive force signal are different from that of a normality. For this reason, a determination of the discharge abnormalities based on the counter electromotive force signal is performed, for example, by regulating in advance a normal range of each component, based on whether or not each component of the detected signal is within the regulated range. Moreover, a detailed description thereof is a well known method; therefore, the description thereof will be omitted.

The printer 1 according to the invention, the CPU 9 sets one nozzle 44 among all the nozzles 44 of the recording head 6 as an examination object nozzle, and applies the second discharge driving pulse DP2 to the piezoelectric element 32 corresponding to the examination object nozzle 44 as a driving pulse for examination. Here, a reason that the second discharge driving pulse DP2 is set to the driving pulse for examination is that the second discharge driving pulse DP2 is easily influenced with negative pressure according to decrease of an ink remaining amount of the ink cartridge 17 in a case in which the ink droplet corresponding to the large-sized dot is discharged by the second discharge driving pulse DP2. That is, since the pressure change in the pressure chamber 42 is as large as when a relatively large amount of ink is discharged, in a case in which the negative pressure of the ink cartridge 17 becomes higher, supply of the ink to the nozzle 44 is not sufficient, and it is easy to have the discharge abnormalities. Therefore, by determining whether or not the ink is normally discharged from the nozzle 44 with the second discharge driving pulse DP2 as the driving pulse for examination, the discharge abnormalities can be effectively detected early.

In addition, after performing the nozzle examination process, the CPU 9 determines whether or not discharging of the examination object nozzle is in an abnormal state (Step S2). When it is determined that the ink droplet corresponding to the large-sized dot can be normally discharged from the examination object nozzle without the discharge abnormalities by the second discharge driving pulse DP2 (No), a recording mode is set to be a first recording mode (Step S3). In addition, the recording process in the first recording mode is performed (Step S5). Here, the first recording mode is a general recording mode of the related art in which recording is performed by any one of gradation of a large-sized dot, a medium-sized dot, a small-sized dot, and non-recording (that is, minute vibration) based on the printing data relating to the series of the printing processes (that is, printing job). That is, in the first recording mode, in the above described driving signal COM, any one of the driving pulses in the first discharge driving pulse DP1, the second discharge driving pulse DP2, the third discharge driving pulse DP3, and a minute vibration driving pulse VP is selectively applied to the piezoelectric element 32 so that the discharging operation (recording process) is performed.

Meanwhile, in Step S2, when the discharge abnormalities are generated, that is, when determining that the ink droplet corresponding to the large-sized dot cannot be discharged from the examination object nozzle by the second discharge driving pulse DP2 (Yes), the CPU 9 set the recording mode to the second recording mode (Step S4). In addition, the recording process is performed in the second recording mode (Step S5). Here, the second recording mode is a mode in which recording is performed by any one of gradation of the medium-sized dot, the small-sized dot, and the non-recording (that is, minute vibration) without using the large-sized dot which generates the discharge abnormalities. That is, in the first recording mode, without using the second discharge driving pulse DP2, any one of the driving pulses of the first discharge driving pulse DP1, the third discharge driving pulse DP3, and the minute vibration driving pulse VP is selectively applied to the piezoelectric element 32 so that the recording process (liquid droplet discharging operation) is performed. In other words, since the ink droplet corresponding to the large-sized dot which is the first size liquid droplet is not discharged from any of nozzles 44, the ink droplets are not discharged from the nozzle 44 corresponding to the first nozzle, but the ink droplets of the medium-sized dot and the small-sized dot as the second size liquid droplet are discharged from the second nozzle. Accordingly, even in a situation in which the discharge abnormalities are generated when the ink in the ink cartridge 17 barely remains and the ink droplet corresponding to the large-sized dot is discharged, the ink droplet corresponding to the medium-sized dot or the small-sized dot is discharged so that the recording process can be continuously performed. Moreover, in this case, a concentration of the recording image, or the like in the first recording mode and the second recording mode can be adjusted so as not to be significantly different from each other by increasing the number of scanning (the number of pulses) of the recording head 6.

During the recording process, the CPU 9 determines whether or not a timing of the nozzle examination has come (Step S6). As a determination reference at this time, a continuous time of recording process, the number of printed recording sheet (the number of pages), the number of scanning operation of the recording head 6 (the number of pulses), a total amount of the ink discharged from each nozzle 44 of the recording head 6, and the like can be adopted. In Step S6, when it is determined whether or not the timing of the nozzle examination has come (Yes) on the basis of the above determination reference, the CPU returns to Step S1 and then performs later processes. Meanwhile, in Step S6, when it is determined whether or not the timing of the nozzle examination has not come yet (No), the CPU goes to Step S7 and performs the process thereof. In addition, when the CPU 79 determines whether or not the recording process is completed (that is, whether or not the series of the printing jobs is terminated on the basis of the printing data) (Step S7), and determines that the process has not been completed yet (No), the process returns to Step S5 and later processes are continuously performed. Meanwhile, in Step S7, when it is determined that the series of the recording processes based on the printing data is terminated (Yes), the CPU terminates the process.

Moreover, in a case in which the recording process is continuously performed in the second recording mode when the nozzle examination timing has come again (Yes in Step S6), in the nozzle examination process in Step S1, with respect to the piezoelectric element 32 corresponding to the examination object nozzle 44, the first discharge driving pulse DP1 for discharging the ink droplets corresponding to the medium-sized dot which is secondly larger after the large-sized dot becomes the driving pulse for examination. In this case, the ink droplet corresponding to the medium-sized dot corresponds to the first size liquid droplet, and the ink droplet corresponding to the small-sized dot corresponds to the second size liquid droplet. Accordingly, in this case, the first discharge driving pulse DP1 corresponds to the first driving pulse in the invention, and the third discharge driving pulse DP3 corresponds to the second driving pulse. In addition, the nozzle 44 which discharges the ink droplet corresponding to the medium-sized dot corresponds to the first nozzle, and the nozzle 44 which discharges the ink droplet corresponding to the small-sized dot corresponds to the second nozzle. In this case, when it is determined that the ink droplet corresponding to the medium-sized dot cannot be discharged from the examination object nozzle (Yes) in Step S2, after that, the recording process is performed only with the ink droplet corresponding to the small-sized dot by the third discharge driving pulse DP3. In addition, finally, when it is determined that the ink droplet corresponding to the small-sized dot cannot be discharged from the examination object nozzle by the third discharge driving pulse DP3 (Yes in Step S2), the recording process is stopped, and a process which promotes for exchange of the ink cartridge 17 to a user (for example, notifying by displaying an instruction on a display apparatus) is performed.

As described above, in the printer in the embodiment, when detecting a state in which the ink droplet is not discharged from the first nozzle which discharges a relatively large ink droplet, the ink droplet is discharged from the second nozzle without discharging the ink droplet from the first nozzle, and the ink can be continuously discharged until a state in which a relatively small ink droplet is not discharged even in a state in which the ink cartridge 17 barely remains. In addition, since it is sufficient to perform an examination on a specific first nozzle which discharges the relatively large ink droplet, the examination may not be performed on all of the nozzles. Accordingly, time needed to examine the discharge abnormalities can be reduced and waste of the ink in the ink cartridge can be suppressed.

Figure 7:
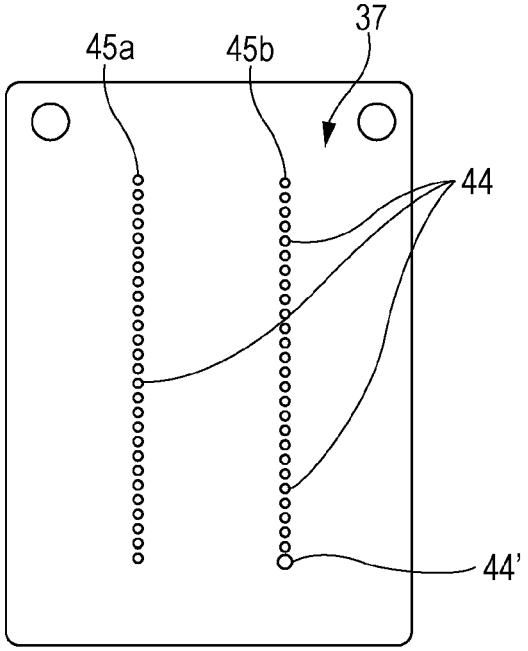
FIG. 7 is a plan view illustrating a configuration of the nozzle plate in a second embodiment.

FIG. 7 is a plan view describing a configuration of the nozzle plate 37 in a second embodiment of the invention. The embodiment is different from the first embodiment in that an opening area in ejecting side of one nozzle 44' among the nozzles 44 of the recording head 6 (hereinafter, referred to as large nozzle 44') is set to be larger than other nozzles 44. In this configuration, for example, when the ink droplet is ejected by applying the same driving pulses to the piezoelectric element 32, the ink droplet which is larger than the ink droplet discharged from other nozzles 44 is discharged from the large nozzle 44'. that is, the large nozzle 44' corresponds to the first nozzle in the invention, and the ink droplet discharged from the nozzle 44' corresponds to the first size liquid droplet. In the same manner, other nozzles 44 correspond to the second nozzle in the invention, and the ink droplet discharged from these nozzles 44 correspond to the second size liquid droplet. In the embodiment, when it is determined that the nozzle examination process is performed on the large nozzle 44' and the discharge abnormalities are generated in the large nozzle 44', after that, the recording process is performed without using the large nozzle 44'. Even in the embodiment, time needed to examine the discharge abnormalities can be reduced and the waste of the ink in the ink cartridge 17 can be suppressed. In addition, the driving pulse for discharging the ink droplet from the nozzle 44' at the time of the examination can be common to the driving pulse for discharging the ink droplet from other nozzles 44. In addition, the examination object is specified to the large nozzle 44', a process which sets a nozzle as the examination object does not need to be performed. Moreover, since other configurations are the same as in above described embodiments, the description thereof will be omitted.

Figure 8:
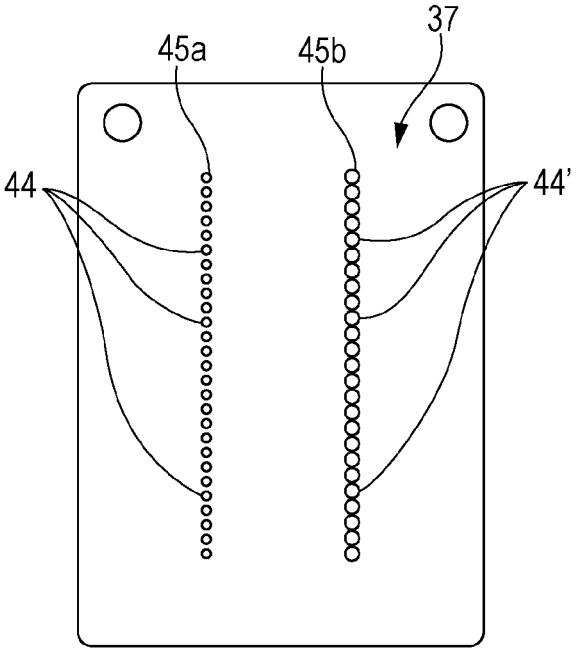
FIG. 8 is a plan view illustrating a configuration of the nozzle plate in a third embodiment.

FIG. 8 is a plan view illustrating a configuration of the nozzle plate 37 in the third embodiment of the invention. In the second embodiment, the configuration in which one large nozzle 44' is installed on the nozzle plate 37 is exemplified, but it is not limited thereto. In the embodiment, the nozzle row 45*b* which is one of a pair of the nozzle rows 45*a* and 45*b* installed in the recording head 6 is configured to have the large nozzle 44', and another the nozzle row 45*a* is configured to have typical nozzles 44. That is, the first nozzle row 45*a* is a nozzle row for discharging the ink droplet corresponding to the small-sized dot, and the second nozzle row 45*b* is a nozzle row for discharging the ink droplet corresponding to the large-sized dot. In the embodiment, when the nozzle examination process is performed on any one or all of the large nozzles 44' in the second nozzle row 45*b*, and it is determined that the discharge abnormalities are generated in the large nozzle 44', after that, the recording process is performed on only the first nozzle row 45*a* without using the second nozzle row 45*b*. Even in the embodiment, the time needed to examine the discharge abnormalities can be reduced and the waste of the ink in the ink cartridge 17 can be suppressed. Moreover, since other configurations are the same as in above described embodiments, the description thereof will be omitted.

Moreover, in each of the above described embodiments, the piezoelectric element 32 is exemplified as an actuator, but it is not limited thereto, and for example, a so called electrostatic force type actuator which displaces a part of the pressure chamber by electrostatic force, or other actuator such as a heating element which generates the pressure change in the pressure chamber due to bubbles generated in the liquid by heating can be adopted.

In addition, regarding the discharging abnormalities detection circuit 14, in the above described embodiment, a configuration in which the discharge abnormalities of the nozzle 44 are detected on the basis of the vibration generated at the time of driving the piezoelectric element 32 is exemplified, but it is not limited thereto. For example, by discharging the ink droplet from the nozzle in a state in which voltage is applied between the nozzle surface and the ink landing surface and charging the ink droplet by detecting a voltage changing, the discharge abnormalities of the nozzle may be detected. In addition, for example, an examination pattern is printed on the recording medium, and an existence or a nonexistence of the discharge abnormalities may be detected by examining the pattern with an optical sensor. Otherwise, the existence or the nonexistence of the discharge abnormalities can be detected by detecting whether or not the flying ink droplet blocks the laser, or detecting a weight of discharged amount of the ink droplet, with an irradiating portion which emits laser and a detecting portion which detects the laser.

In addition, the invention is not limited to the printer as long as the liquid discharging apparatus has a configuration in which liquid in a liquid storage member is introduced into the liquid discharging head and is discharged from the nozzle, and can be used in a plotter, a facsimile machine, a copy machine, various ink jet type recording apparatuses, or a printing apparatus which performs printing by making the ink landing from a liquid discharging head onto fabric (material to be printed) which is a type of a landing object, or a liquid discharging apparatus other than recording apparatuses, for example, a display manufacturing apparatus, an electrode manufacturing apparatus, and a chip manufacturing apparatus.

What is claimed is:

1. A liquid discharging apparatus comprising:

a liquid discharging head that includes first nozzles which discharge first size liquid droplets and a second nozzle which discharges a second size liquid droplet smaller than the first size liquid droplet;

a discharging abnormalities detection circuit that detects a state in which the liquid droplets are discharged from the nozzles of the liquid discharging head; and a control circuit that controls discharging of the liquid droplets from the liquid discharging head, wherein the discharging abnormalities detection circuit firstly detects the state in which the first size liquid droplet is discharged from one of the first nozzles, wherein when the discharging abnormalities detection circuit detects a state in which the first size liquid droplet is not normally discharged from one of the first nozzles, the control circuit makes the liquid discharging head discharge the second size liquid droplet from the second nozzle without making the liquid discharging head discharge the first size liquid droplet from another of the first nozzles, and wherein a discharge abnormalities examination performed by the discharging abnormalities detection circuit is based on examination of only a single nozzle.

2. The liquid discharging apparatus according to claim 1, wherein an opening area of each of the first nozzles is larger than that of the second nozzle.

3. The liquid discharging apparatus according to claim 1, further comprising:

an actuator that discharges the liquid droplets from the nozzles; and a driving pulse generating circuit that generates a driving pulse which drives the actuator, wherein the driving pulse generating circuit is capable of generating a first driving pulse for discharging the first size liquid droplet and a second driving pulse for discharging the second size liquid droplet, and wherein the control circuit applies the first driving pulse to the actuator corresponding to the first nozzles and applies the second driving pulse to the actuator corresponding to the second nozzle.

4. The liquid discharging apparatus of claim 1, wherein the first nozzles and second nozzle are included in a nozzle plate that includes first and second opposing rows of nozzles configured and arranged so that a nozzle in the first row is disposed opposite a nozzle of the same size in the second row.

5. The liquid discharging apparatus of claim 1, wherein the first nozzles and second nozzle are included in a nozzle plate that includes first and second opposing rows of nozzles configured and arranged so that all the nozzles in the first row are the same size, and all the nozzles in the second row are the same size, and the nozzles of the second row are of a different size than the nozzles of the first row.

6. The liquid discharging apparatus of claim 1, wherein the first nozzles and second nozzle are included in a nozzle plate that includes first and second opposing rows of nozzles configured and arranged so that all the nozzles in the first row are the same size, and all but one of the nozzles in the second row are the same size as the nozzles in the first row, the one nozzle of the second row being larger than the other nozzles of the second row.

7. The liquid discharging apparatus of claim 1, wherein when the discharging abnormalities detection circuit detects an abnormal discharge of the first size liquid droplet from the first nozzle, printing by the liquid discharging apparatus continues with only the second nozzle and not the first nozzle.

8. A control method of a liquid discharging apparatus including a liquid discharging head that includes first nozzles which discharge first size liquid droplets and a second nozzle which discharges a second size liquid droplet smaller than the first size ink droplet, a discharging abnormalities detection circuit that detects a state in which the liquid droplets are discharged from the nozzles of the liquid discharging head, and a control circuit that controls discharging of the liquid droplets in the liquid discharging head, the control method comprising:

discharging a liquid droplet from a second nozzle without discharging the liquid droplet from one of the first nozzles when detecting by the abnormalities detection circuit a state in which the liquid droplet is not normally discharged from another of the first nozzles, and wherein a discharge abnormalities examination performed by the discharging abnormalities detection circuit is based on examination of only a single nozzle.

9. A liquid discharging apparatus comprising:

a liquid discharging head that includes first nozzles which discharge first size liquid droplets and a second nozzle which discharges a second size liquid droplet smaller than the first size liquid droplet;

a discharging abnormalities detection circuit that detects a state in which the liquid droplets are discharged from the nozzles of the liquid discharging head; and a control circuit that controls discharging of the liquid droplets from the liquid discharging head, wherein the discharging abnormalities detection circuit detects the state in which the liquid droplet is discharged from one of the first nozzles before the second nozzle, and wherein when the discharging abnormalities detection circuit detects a state in which the liquid droplet is not normally discharged from one of the first nozzles, the control circuit makes the liquid discharging head discharge the liquid droplet from the second nozzle without making the liquid discharging head discharge the liquid droplet from another of the first nozzles.

10. A liquid discharging apparatus comprising:

a liquid storage member configured to store a liquid;

a liquid discharging head operable to discharge a liquid droplet supplied from the liquid storage member in a plurality of liquid droplet sizes;

a discharging abnormalities detection circuit operable to detect a state in which the liquid droplets are discharged from the liquid discharging head;

a control circuit operable to control discharge of the liquid droplets from the liquid discharging head, wherein when the discharging abnormalities detection circuit detects a state in which the liquid droplet in a first droplet size is not normally discharged from a first nozzle of the liquid discharging head, a detection target by the discharging abnormalities detection circuit is directed to a liquid droplet in a second droplet size smaller than the first droplet size and the control circuit makes the liquid discharging head not discharge the liquid droplets in the first droplet size from a second nozzle; and wherein when the discharging abnormalities detection circuit detects that the second droplet size is not normally discharged from the liquid discharging head, the liquid discharging apparatus transmits an instruction to exchange the liquid storage member.

* * * * *